US009354022B2

(12) United States Patent
Eriksson et al.

(10) Patent No.: US 9,354,022 B2
(45) Date of Patent: May 31, 2016

(54) OPTICAL AIMING DEVICE WITH RECOIL DAMPENING MEANS

(75) Inventors: Niklas Eriksson, Savedalen (SE); Kennet Jan Ake Vilhelmsson, Ojersjo (SE); Hans Olsson, Vintrosa (SE); Per Olof Yngve Ostergren, Odensbacken (SE)

(73) Assignee: REDRING AB, Hono (SE)

( * ) Notice: Subject to any disclaimer, the term of this patent is extended or adjusted under 35 U.S.C. 154(b) by 0 days.

(21) Appl. No.: 13/495,332

(22) Filed: Jun. 13, 2012

(65) Prior Publication Data

US 2013/0145666 A1 Jun. 13, 2013

(51) Int. Cl.

| | |
|---|---|
| ***F41A 21/00*** | (2006.01) |
| ***F41G 1/387*** | (2006.01) |
| ***F41G 1/30*** | (2006.01) |
| ***F41G 11/00*** | (2006.01) |

(52) U.S. Cl.
CPC *F41G 1/387* (2013.01); *F41G 1/30* (2013.01); *F41G 11/002* (2013.01)

(58) Field of Classification Search
CPC ..... F41G 1/387; F41G 1/30; F41G 1/002
USPC ..... 42/1.06, 111, 115, 124, 131
See application file for complete search history.

(56) References Cited

U.S. PATENT DOCUMENTS

| | | | | |
|---|---|---|---|---|
| 2,510,289 | A * | 6/1950 | Livermore | 42/125 |
| 3,260,008 | A * | 7/1966 | Yeomans, Jr. | 42/111 |
| 4,026,054 | A | 5/1977 | Snyder | |
| 4,027,414 | A | 6/1977 | Felix | |
| 4,665,622 | A * | 5/1987 | Idan | 42/113 |
| 4,764,011 | A * | 8/1988 | Goldstein | 356/251 |
| 4,899,479 | A * | 2/1990 | Sanders | 42/112 |
| 5,425,191 | A | 6/1995 | Taylor et al. | |
| 5,483,362 | A * | 1/1996 | Tai et al. | 359/1 |
| 6,373,628 | B1 * | 4/2002 | Gunnarsson et al. | 359/428 |
| 6,421,946 | B1 * | 7/2002 | LoRocco | 42/111 |

(Continued)

FOREIGN PATENT DOCUMENTS

| | | | |
|---|---|---|---|
| DE | 2703990 | A1 | 8/1978 |
| FR | 492773 | A | 7/1919 |

(Continued)

OTHER PUBLICATIONS

International Search Report completed on Aug. 12, 2010 and mailed on Aug. 13, 2010 in connection with PCT Application No. PCT/SE2009/051461.

(Continued)

*Primary Examiner* — Michelle R Clement
(74) *Attorney, Agent, or Firm* — Gesmer Updegrove LLP

(57) ABSTRACT

The present invention relates to an optical aiming device of the type having a light source and a mirror or lens reflecting or projecting an image of a reticle, i.e. a sight, to the eye of a user. The optical aiming device comprises means for attaching the optical aiming device to a weapon, such as a shot gun. The optical aiming device comprises a base part comprising the opticals and at least one attachment member for attaching the base part to the weapon. The base part and at least one attachment member are displaceable with respect to each other. The relative displacement can effectively be used to dampen the recoil force imparted to the base part carrying the sensitive opticals of the optical aiming device, e.g. by at least one force absorbing member.

12 Claims, 8 Drawing Sheets

(56) References Cited

U.S. PATENT DOCUMENTS

| | | | | |
|---|---|---|---|---|
| 6,640,481 | B1 | 11/2003 | Williams | |
| 6,967,775 | B1 * | 11/2005 | Millett | 359/399 |
| 6,978,569 | B2 * | 12/2005 | Williamson et al. | 42/132 |
| 8,136,287 | B2 * | 3/2012 | Adams | 42/124 |
| 8,205,375 | B1 * | 6/2012 | Swan | 42/124 |
| 8,245,433 | B1 * | 8/2012 | Smith | 42/112 |
| 8,347,544 | B1 * | 1/2013 | Swan | 42/124 |
| 8,429,845 | B1 * | 4/2013 | Swan | 42/90 |
| 2002/0078618 | A1 | 6/2002 | Gaber | |
| 2003/0012015 | A1 * | 1/2003 | Schiller et al. | 362/110 |
| 2004/0016169 | A1 | 1/2004 | Poff | |
| 2004/0244263 | A1 | 12/2004 | Pettersson et al. | |
| 2006/0048432 | A1 * | 3/2006 | Staley, III | 42/122 |
| 2006/0164704 | A1 | 7/2006 | Sieczka et al. | |
| 2008/0244953 | A1 * | 10/2008 | Kilic | 42/127 |
| 2009/0193705 | A1 * | 8/2009 | LoRocco | 42/123 |

FOREIGN PATENT DOCUMENTS

| | | | |
|---|---|---|---|
| FR | 2581746 | A1 | 11/1986 |
| WO | 9531740 | A1 | 11/1995 |

OTHER PUBLICATIONS

Revised International Search Report mailed on May 10, 2012 in connection with PCT Application No. PCT/SE2009/051461.

International Preliminary Report on Patentability mailed on Mar. 22, 2012 in connection with PCT Application No. PCT/SE2009/051461.

* cited by examiner

OPTICAL AIMING DEVICE WITH RECOIL DAMPENING MEANS

PRIORITY INFORMATION

This application is a continuation of PCT Application No. PCT/SE2009/051461 filed on Dec. 18, 2009 which is incorporated herein by reference in its entirety.

TECHNICAL FIELD

The present invention relates to an optical aiming device having a force absorbing member.

BACKGROUND OF THE INVENTION

Optical aiming devices which have a reticle produced from a light source, such as a light emitting diode (LED) or laser diode, are commonly used for aiming firearms, such as pistols, rifles or shot guns or the like. The reticle is projected onto a semi transparent mirror or lens which reflects the reticle image onto the eye retina of the user, i.e. the shooter. Hence the user can see both the field of view and the projected image of the reticle simultaneously. The mirror or lens is usually a semi transparent concave mirror which reflects the light from the light source as collimated beams; this enables a parallax free image of the reticle. If only the reticle can be seen, the aiming device is operational. The viewer also perceives the reticle as if the reticle is located at a very remote position from the optical aiming device. The reticle can be dots, rings or other patterns.

One optical aiming device is described in the patent application of US 2002/0078618 A1. The optical sight in the document comprises a light emitting diode which is arranged in working cooperation with a plurality of reticle patterns which can be selectively illuminated. The selective illumination is done by connecting various portions of the reticle's patterns to the source of the power supply. By selectively illuminating different reticles, the viewer is said to enable a high accuracy in positioning the reticle elements. No moving parts are used as the illumination of the reticle is done by means of electrically switching between the reticle patterns. The brightness of the image can be adjusted by changing the current supplied to the LED. Further, a feedback line can be connected to adjust the brightness of the LED as a function of the environmental lighting conditions. The document is however silent of how to achieve this.

US 2006/0164704 A1 disclose an optical sight similar to the one described above which uses a laser emitting diode as a light source. The laser diode emits the light onto a semi-transparent mirror which reflects the light in the form of a reticle image onto the retina of the viewer. The brightness of the reticle can be changed by manipulating the duty cycle of the signals that is applied to the laser diode. The proposed solution only regulates the standard illumination of the reticle.

During shooting with e.g. a shot-gun, an immense impact force is imparted to the optical aiming device. A drawback with the above mentioned optical sights is that they are very sensitive to the force imparted to the aiming device during shooting, such force may cause lens rupture, lens misalignment or the like.

SUMMARY OF THE INVENTION

It is an object of the present invention to at least partly solve the above mentioned drawbacks, or to at least to provide a useful alternative. The object of the present invention is at least partly solved by an optical aiming device according to the present invention. The optical aiming device comprises a base part having a longitudinal centre axis, a distal and a proximal end and comprising means for attaching the aiming device to a weapon, such as a shot gun. The base part comprises the optical parts used for aiming. The means for attaching the optical aiming device comprises at least a first attachment member for attaching the base part to the weapon, wherein the base part is after assembly with the weapon enabled to move with respect to at least the first attachment member along the longitudinal centre axis between a first and a second relative position. The optical aiming device further comprises at least a one force absorbing member adapted to at least reduce the kinetic energy of the base part during the relative motion. The present invention provides for a recoil absorbing mechanism to the optical aiming device, which significantly reduces the risk of the optical aiming device being imparted with a disruptive force or wear during firing with the weapon.

The means for attaching the optical aiming device to the weapon is specifically advantageous when used with an optical aiming device having a mirror or lens; a light source, the light source being arranged to project light on the mirror or lens. The mirror can be arranged to reflect or redirect at least parts of the light in a first direction, the projected light forming an image of a sight which can be perceived by a user. These optical aiming devices have been found be significantly sensitive to the disruptive force subjected to the optical aiming device during firing, especially when using shot guns.

Although there are many alternative way of performing the invention, according to one embodiment, the at least one force absorbing member can be arranged between the first attachment member and the base part. This dampens the force imparted to the optical aiming device from the recoil of the weapon during and after firing. The optical aiming device advantageously comprises a second attachment member. The first and second attachment members can be arranged at the distal and the proximal end of the base part respectively, for example. This will effectively dampen any oscillating motion imparted to the base part of the optical aiming device. Advantageously a second force absorbing member is arranged between the second attachment member and the base part. As will be described below, the force absorbing member can have through going holes for enabling guiding pins to extend there through or have no through going holes, at which guiding pins is arranged to extend past the periphery of the force absorbing member or optionally onto the force absorbing member. Combinations of these embodiments are also possible.

The first and/or the second force absorbing member can be made from a flexible and resilient material such as natural or synthetic rubber, elasteomer or the like. The material should be enabled to be compressed while tend to return to its original form after compression. The material does not have to be a truly compressible material; it is enough that there is one dimension of the material that can be compressed, e.g. being compressed along the length of the material.

In an embodiment of the present invention, the base part is enabled to move along the longitudinal centre axis with respect to at least the first attachment member by means of at least one guiding pin and guiding groove. As an illustrative non limiting example, by having at least one guiding pin and guiding groove, the base part is effectively prevented from movement in a direction perpendicular to the longitudinal centre axis, while stilt being permitted to a relative motion between the first attachment member along the longitudinal centre line. The longitudinal centre line of the optical aiming device is preferably aligned with the barrel of the weapon and advantageously the line between a target and an eye of the user.

At least one guiding pin can be arranged on the base part. Generally at least two, three four or more guiding pins are possible, although four guiding pins are preferred. A corresponding amount of guiding grooves are generally preferred on the first attachment member, optionally on the second attachment member. Advantageously, the base part comprises two guiding pins in each end, i.e. the proximal and distal end and each attachment member comprises two guiding grooves. It should be noted however that the base part, first attachment member and the second attachment member can comprise both guiding pins and guiding grooves. The guiding pin(s) can be an integral part of the base part, first attachment member and/or the second attachment member, or a separate piece of material attached thereto.

Due to the resiliency of the force absorbing members, the positioning of the first and the second attachment member is less sensitive for misalignment as such misalignment would be compensated by the compressibility of the first and the second attachment members and the guiding pins.

In an embodiment according to the present invention, at least one force absorbing member comprises at least one through hole through which the guiding pin is adapted to extend after assembly. In cases were the base part or the first or second attachment member comprises at least two guiding pins, the first absorbing member advantageously comprises at least two through holes through which the guiding pins are adapted to extend after assembly.

Generally the present invention relates to an aiming device e.g. of the type having a light source and a reflective mirror or lens reflecting or projecting an image of a reticle, i.e. a sight, to the eye of a user. The aiming device comprises means for attaching the aiming device to a weapon, such as a shot gun. The aiming device comprises a base part comprising the optics, e.g. the reflective mirror or lens, and at least one attachment member for attaching the base part to the weapon. The base part and the at least one attachment member are displaceable with respect to each other. The relative displacement can effectively be used to dampen the recoil force imparted to the base pert carrying the sensitive optics of the aiming device. These dampening features can be improved by at least one force absorbing member.

The mirror or lens can advantageously be a partly transparent mirror. A lens is used when the light source is projected directly towards the intended user, and not mirrored towards the user.

BRIEF DESCRIPTION OF THE DRAWINGS

The present invention will be described in greater detail with reference to the accompanying figures in which.

DETAILED DESCRIPTION OF PREFERRED EMBODIMENTS

Figure 1:
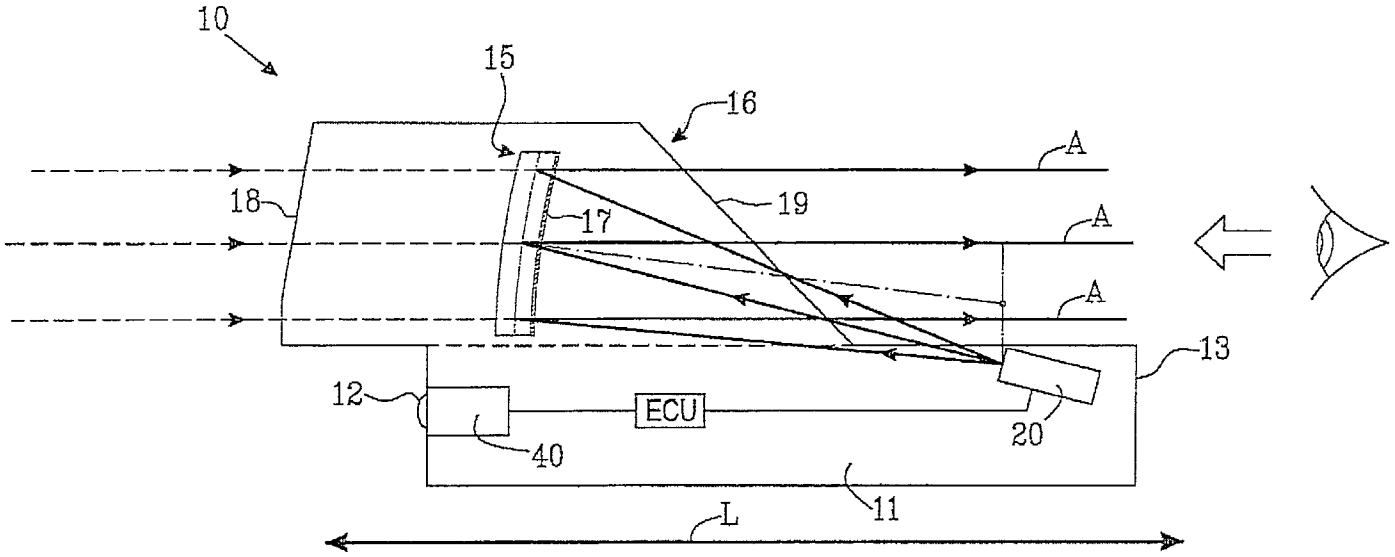
FIG. 1 shows a schematic view from the side and shown partly with a transparent housing of an optical aiming device according to the present invention.

FIG. 1 shows an aiming device 10 having a base part 11. The base part 11 is adapted to be fitted onto a firearm, such as a shot-gun, assault rifle, hunting rifle, pistol or the like by means of a dovetail connection or attachment screw or the like (not shown). The base part 11 exhibits a longitudinal extension L, a distal end 12 and a proximal end 13. A first and a second longitudinal side 14, 15. The distal end 12 is after assembly with the firearm intended to be closer to the target while the proximal end 13 is intended to be facing towards the eye of the user, i.e. the viewer or shooter, during aiming. The aiming device 10 comprises a partly transparent mirror 15, or semi transparent mirror 15, in the shown embodiment substantially in the form of a pellicle. The partly transparent mirror 15 is arranged substantially vertically to the base part 11 and is fixed in a mirror frame 16. The base part 11 and the frame 16 are displayed slightly transparent in FIG. 1 to provide a clearer illustration of the separate arrangements and functions of the aiming device 10.

The partly transparent mirror 15 comprises a slightly concave surface facing the proximal end 13 so as to reflect the light from a light source 20 as indicated by the arrows A. The concave surface is arranged to reflect the light as a collimated beam towards a user and the proximal end 13 of the aiming device 10. The partly transparent mirror can be coated with a light reflecting coating 17. The light reflecting coating 17 preferably reflects light having a wave length of about 650 nm±10 nm, which is generally seen as red light. However, other light intervals may be used light perceived as yellow, green, blue or orange for example. Optionally, the color of the light can be determined by the choice of light source or combinations thereof.

The mirror frame 16 is a rigid frame in which the partly transparent mirror 15 is fixed. The mirror frame 16 is intended to protect the partly transparent mirror 16 from disruptive forces such as compression forces if the aiming device is accidentally dropped. A first and a second opening 18, 19 permit a user, visualized by the eye in FIG. 1, to see through the frame 16 and of course the partly transparent mirror 15 to view a target.

The light source 20 can be a light emitting diode (LED) 20 with either an external or internal power source, with respect to the aiming device. A lithium battery (not shown) can be incorporated into the base part 11 or means for connecting the light source to a power source may be arranged to the aiming device 10 and preferably the base part. The light source 20 is arranged offset to a centre axis of the aiming device 10 and positioned at a distance from the partly transparent mirror 15, the distance being substantially half the distance of the radius of the curvature of the concave surface of the partly transparent mirror 15, so that the light reflected on the partly transparent mirror 15 is reflected as a collimated beam, as indicated by the arrows in FIG. 1. When the light, indicated by the arrows A carries a sight, i.e. an image such as a circle, the sight will be virtually projected onto the target and perceived by a user as if the sight is positioned a distance away form the user.

The sight however is projected onto the retina of the user during aiming. The firearm is aimed by superimposing the sight onto the desired target.

The aiming device 10 further comprises a light sensor arrangement 40. The light sensor arrangement 40 is arranged at the distal end 12 of the aiming device 10 and detecting light from the area in front of the aiming device only, as will be described below. The light sensor arrangement 40 detects the intensity of the light in the ambient environment in front of the aiming device. However, due to the configuration of the light sensor arrangement 40, light from a predetermined area at a predetermined distance from the light sensor arrangement 40 is collected. The light is due to the present invention can be collected from the actual target area, i.e. a predetermined area, and at least from the area superimposed by the sight. The predetermined area is specified as a function of the distance from the light sensor arrangement, and more specifically from a lens used in the light sensor arrangement. An electronic control unit ECU, microprocessor or CPU, is arranged in working cooperation with the light sensor arrangement 40 and the light source 20 or optionally with the power source of the light source 40, to adjust the intensity of the sight as a function of the detected light intensity of a predetermined area at a distance of about 20 meters. The user thus gets an automatic adjustment of the light intensity of the sight as a function of the light reflecting properties which at least the sight superimposes.

Figure 2:
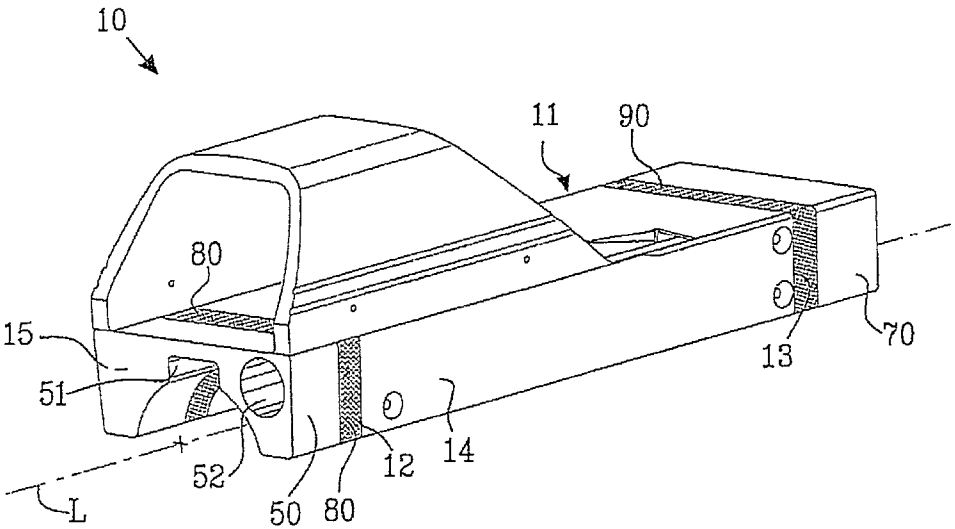
FIG. 2 shows the optical aiming device from FIG. 1 seen in perspective.

FIG. 2 shows the optical aiming device 10 shown in FIG. 1 in perspective, having a first and a second attachment member 50, 70. The optical aiming device is shown with a virtual longitudinal centre axis L, which extends at the centre of the optical aiming device 10 in the longitudinal direction. As is noticed, the first attachment member 50 is arranged in the proximity of the distal end 12 of the base part 11, while the second attachment member 70 is arranged at the proximal end 13 of the base part 11. The first and the second attachments members 50, 70 are each adapted to be attached to the weapon. In the shown embodiment of FIG. 2, the intended weapon is a shot gun. Each of the first and the second attachment members 50, 70 comprises an attachment groove, in FIG. 2 only the attachment groove 51 of the first attachment member 50 is shown. It should be noted that the base part 11 is also configured with an attachment groove (not shown) for snugly attachment of the optical aiming device 10. A first and a second force absorbing member 80, 90 are further shown.

The base part 11 is not attached to the weapon itself; instead the optical aiming device 10, according to the present invention, is movably arranged to the first and the second attachment members 50, 70 after assembly to a weapon. The base part 11 is thus adapted to slide between at least a first and a second position at least after assembly.

As is further seen in FIG. 2, the first attachment member 50 comprises a through hole 52 for permitting the light sensor arrangement 40 to detect light through said through hole 52. It is possible to have the light sensor arrangement detecting light through the through hole 52 as the light sensor arrangement 40 is adapted to detect the reflected light from a predetermined area at a predetermined distance from the light sensor arrangement 40. The through hole 52 is positioned offset with respect to the longitudinal centre line L and near the first longitudinal side 14. As a consequence, the light sensor arrangement 40 does not prevent the partly transparent mirror 15, as shown in FIG. 1, to be positioned really close to the attachment groove 51, and thus the weapon itself, as is shown in FIG. 3.

Figure 3:
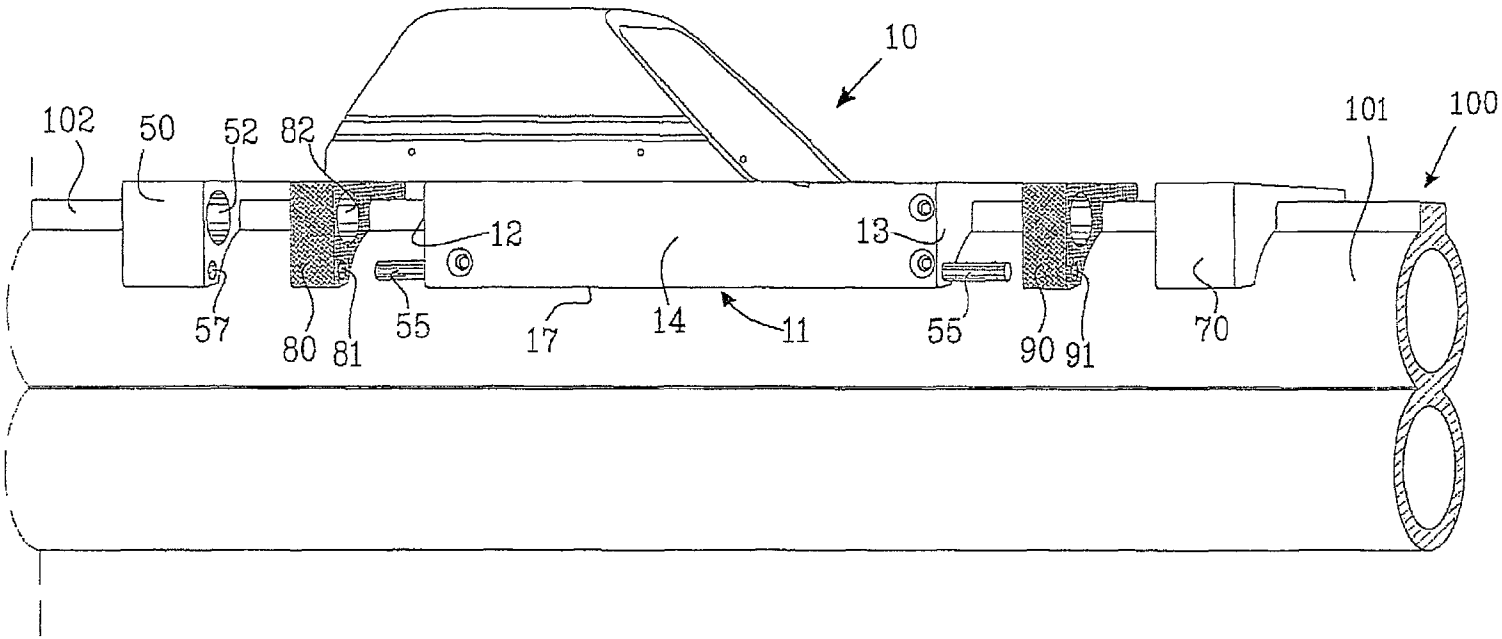
FIG. 3 shows the optical aiming device from FIG. 1 and the attachment arrangements in an exploded view.

FIG. 3 shows parts of the barrels of a break action breech loading double barrel "over and under" shot gun 100, having the barrels vertically positioned one on top of the other. FIG. 3 also shows an exploded view of parts of the optical aiming device 10 shown in FIGS. 1 and 2. The top barrel 101 comprises an aiming bridge 102 along which a user generally aims upon firing the shot gun. The optical aiming device 10, in the shown embodiment according to the present invention, is adapted to be attached to the aiming bridge 102 of the shot gun. More specifically is the attachment groove 51 of the first and the second attachment members 50, 70 adapted to be fixed to the aiming bridge 102.

The present attachment arrangement for the optical aiming device 10 will be described with reference only to the first attachment member 50 in FIG. 3, however it should be noted that the optical aiming device 10 can be provided with a second attachment member 70, as described above, which is provided with the same features as described with reference to the first attachment member 50.

The base part 11 is equipped with four guiding pins 55, of which only two are shown in FIG. 3. Although only two guiding pins are described, each feature is applicable to all guiding pins of the optical aiming device 10. The guiding pins 55 are positioned in close proximity to the first side 14 of the base part 11 and a lower side 17, the lower side 17 being the opposite side to the side which the partly transparent mirror 15 is arranged. Two guiding pins are arranged in a similar manner in close proximity to the side opposite to the first side 14 (not shown in FIG. 3). The pins 55 extend about 1-2 cm away from the distal end 12 of the base part 11, and away from the proximal end 13 of the base part 11, and is intended to be in working cooperation with the first and second attachment members 50, 70 after assembly therewith. Each guiding pin 55 extends substantially parallel with the longitudinal centre axis L.

In the shown embodiment, the first and second attachment members 50, 70 comprises a first and a second guiding groove, of which only the first guiding groove 57 of the first attachment member 50 is shown. The guiding grooves 57 are adapted to be in working cooperation with the guiding pins 55 of the base part 11 at least after assembly with each other.

A first force absorbing member 80 is positioned between the distal end 12 of the base part 11 and the first attachment member 50. Likewise a second force absorbing member 90 is positioned between the proximal end 13 of the base part 11 and the second attachment member 70. The force absorbing members 80, 90 comprises through holes 81, 91 through which the guiding pins 55 of the base part 11 are adapted to extend through. As can further be seen in FIG. 3, the first force absorbing member 80 also comprises a second through hole 82 adapted to permit light to reach the light sensor arrangement 40 and positioned to be aligned with the through hole 52 of the first attachment member 50.

Figure 4:
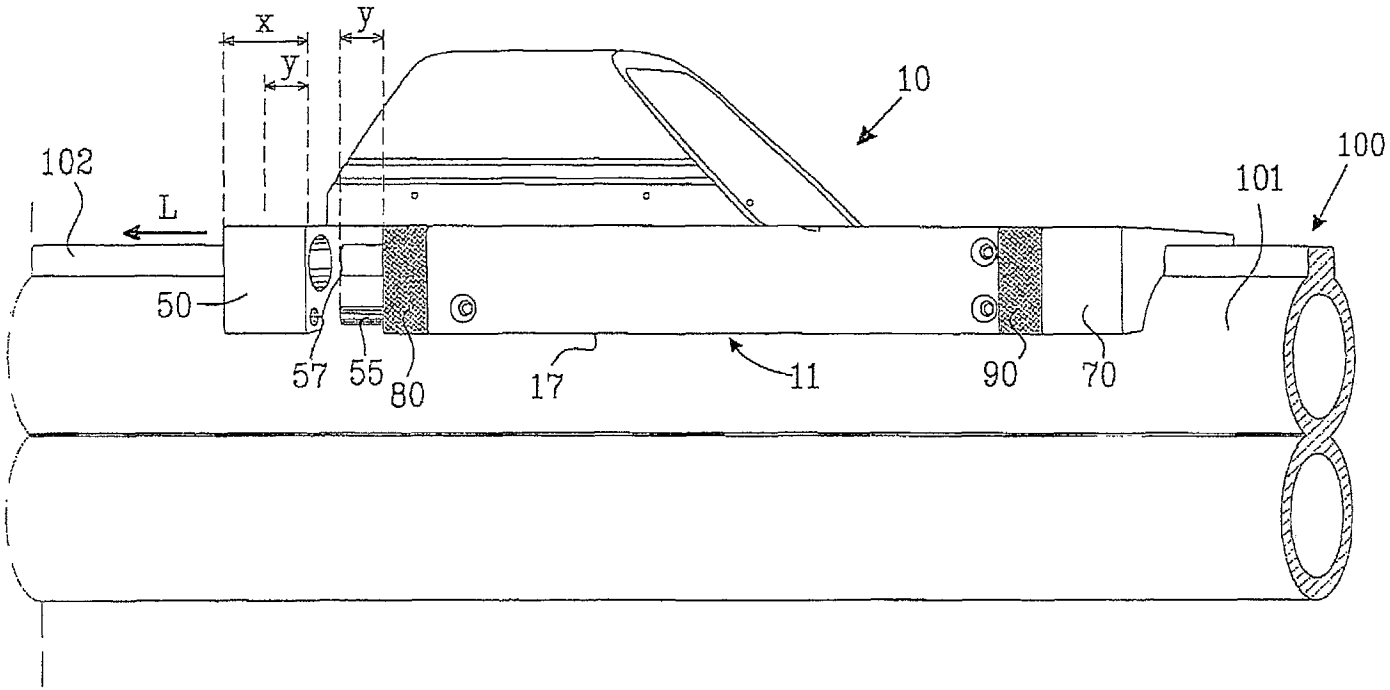
FIG. 4 shows the embodiment of FIG. 3 during assembly with the first attachment member.

FIG. 4 shows the optical aiming device 10 shown in FIGS. 2 and 3 during, assembly with the first attachment member 50. As can be seen, the first force absorbing member 80 is snugly fitted onto the guiding pin 55 of the base part 11. The guiding pin 55 can thereafter be inserted into the guiding groove 57 of the first attachment member 50. The diameter of the guiding groove 57 is just somewhat larger than the diameter of the guiding pin 55 so that the guiding pin 55 of the base part 11 can be inserted into the guiding groove 57 of the first attachment member 50 but not displaced in a direction perpendicular to the longitudinal centre line L.

The guiding groove 57 of the first attachment member 50 is however at least 10% longer than the remaining distance Y, i.e. the length of the guiding pin 55 which extends from the first force absorbing member 80 and optionally from the through hole 81 of the force absorbing member 80 if the force absorbing member 80 has such a through hole. This is indicated by the distance X, along which the protruding length Y has been outlined for comparative reasons. Although only one guiding pin 55 and one guiding groove 57 is described here, the optical aiming device 10 can be provided with at least two such pairs, advantageously at least four such pairs to stabilize the base portion to the first and/or second attachment member (s) 50, 70.

As is readily understood from the above and FIG. 4, after assembly, the base part 11 is thus movably connected to the first and the second attachment member via guiding grooves 57 and guiding pins 55. However, the movement of the base part 11 with respect to the first and the second attachment members 80, 90 is substantially restricted to an extension along the longitudinal centre axis L. Furthermore, the first and the second force absorbing members 80, 90 will effectively absorb the imparted shock force to the optical aiming device 10 from the explosion of the charge in the shell when firing the weapon. Furthermore, the first and the second force absorbing members 80, 90 are adapted to return the base part 11 to its original position which it had before the firing of the weapon, thus removing any misalignments to the optical aiming device 10 imparted due to the relative movement of the base part 11 of the optical aiming device 10.

Figure 5:
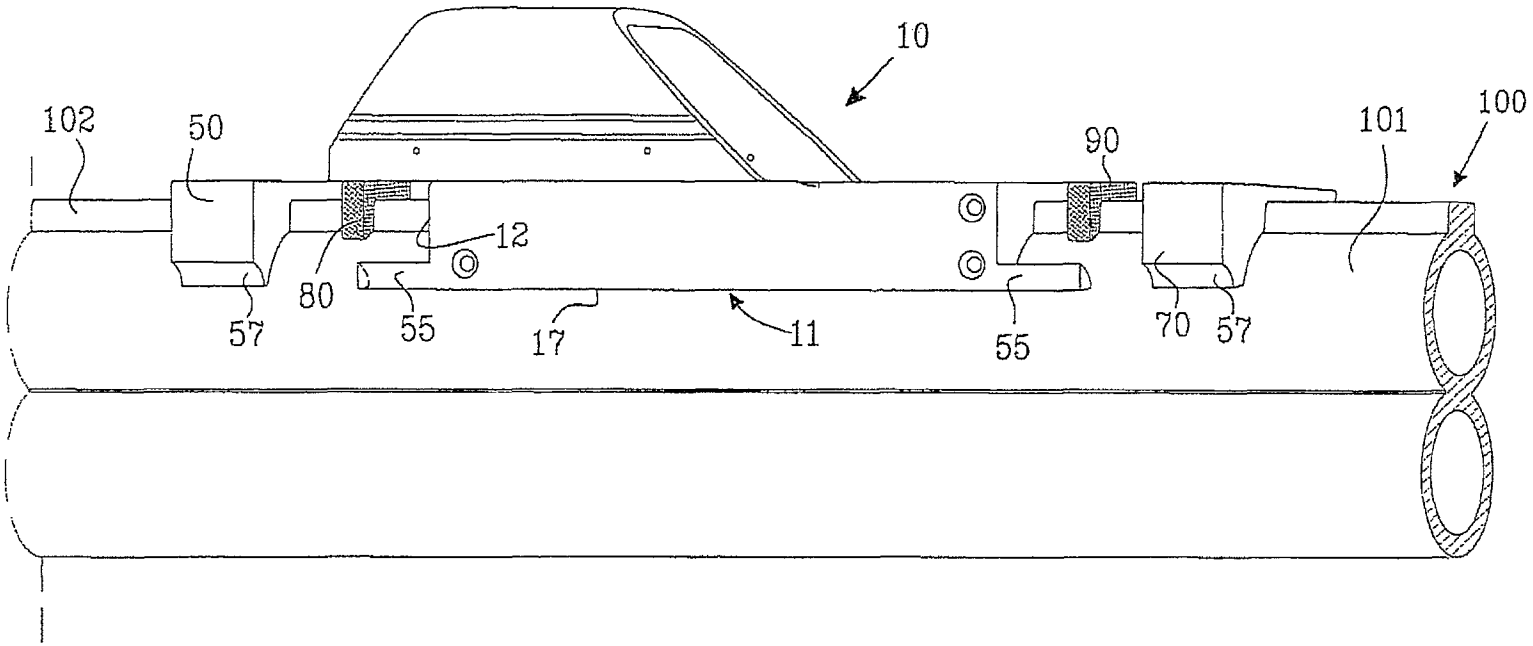
FIG. 5 shows an embodiment of an optical aiming device and the attachment arrangements in an exploded view.

FIG. 5 shows a similar embodiment as shown in FIGS. 2-4. In FIG. 5, the guiding pins 55 are formed integrally with the base pail 11. The guiding grooves 57 of the first and the second attachment member 50, 70 are formed from cut outs in the first and the second attachment members 50, 70. However, cut outs are not a requirement, through going holes as shown in FIG. 3, can also be used should the guiding pins 55 be positioned elsewhere, i.e. other than as indicated in FIG. 5. Furthermore, the first and the second force absorbing member 80, 90 does not exhibit any through going holes as the guiding pins 55 are formed as an extension of the side 14 of the base part 11. As such, the force absorbing members 80, 90 does not need to exhibit any through going holes. As an alternative to having one separate force absorbing member 80, 90 on each side of the base part 11, a plurality of smaller force absorbing members can be used.

Figure 6:
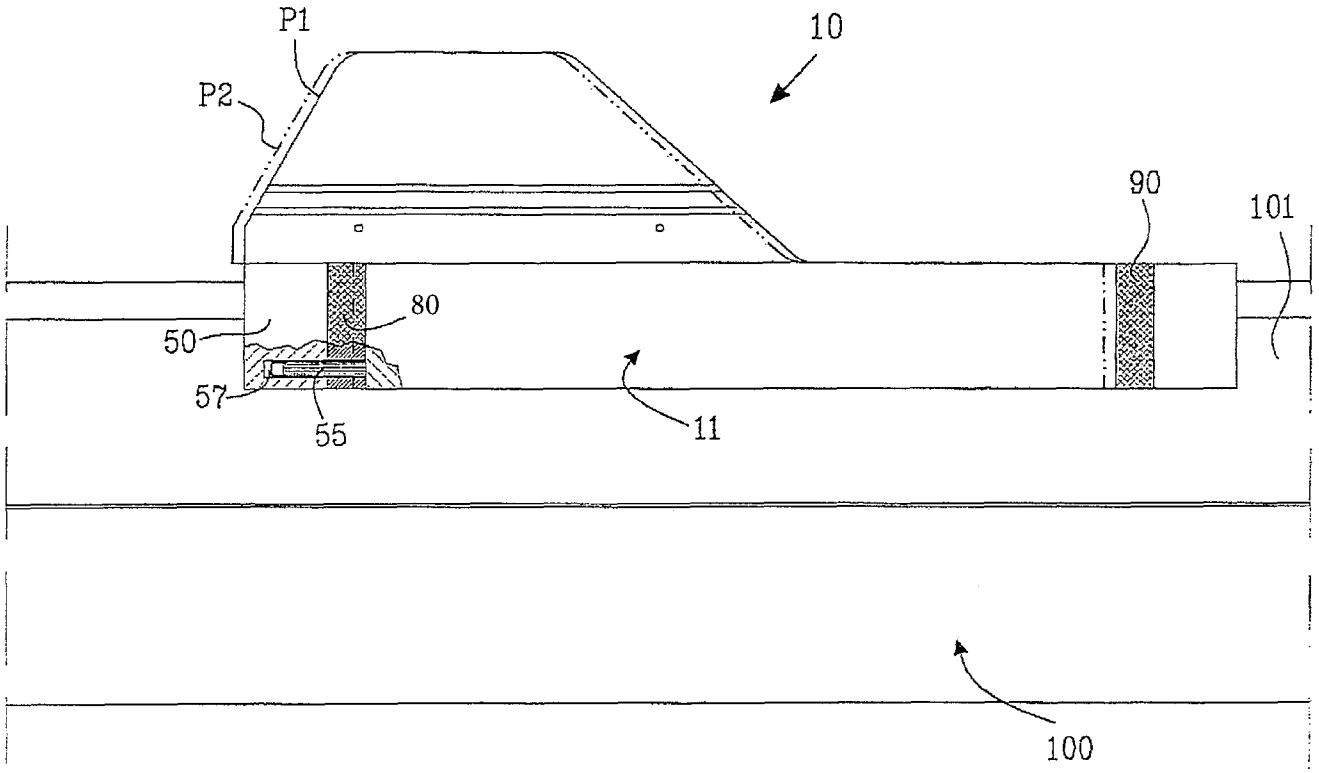
FIG. 6 shows the embodiment of the optical aiming device shown in FIG. 2 after assembly and with its relative positions before and after firing, with respect to the weapon.

Turning to FIG. 6 the function of the aiming device 10 will be described in greater detail. Before firing the shot gun 100, the optical aiming device 10 is positioned in a first position, indicated in FIG. 5 with reference $P_1$. The moment after firing, the shot gun 100 recoils towards the user. As the base part 11 is movably connected to the first and the second attachment members 50, 70, the base part 11 substantially remains in the first position $P_1$ for a split of a second due to the inertia of the base part 11, in FIG. 5 this is illustrated with the dotted lines and reference $P_2$. During the relative motion between the base part 11 and the shot gun 100, the first force absorbing member 80 absorbs the inertia of the base part 11 and slows down the relative movement of the base part 11, to finally stop the relative movement. After absorbing all of the inertia of the base part 11, the force absorbing member 80 imparts a counter force to the base part 11 to return the base part 11 to its original position $P_1$ with respect to the first and the second attachment members 50, 70. The counter force being imparted by the compressibility of the force absorbing member 80. The second force absorbing member 90 generally provides for a smooth stop at the first position $P_1$ and partly absorbs any excessive force remaining. It should be noted that the first and the second force absorbing members 80, 90 together cooperates to return the base part 11 to its original relative position $P_1$ in terms of that the base part 11 exhibits a substantially oscillating motion between the first and the second attachment members 50, 70 after firing. The oscillating motion being dampened relatively quickly by both the first and the second force absorbing members 80, 90. Thus the at least one force absorbing member functions as a recoil brake for the base part of the aiming device.

The force absorbing members 80, 90 are advantageously made from natural or synthetic rubber, preferably natural rubber. Elastomers or thermoplastics can also be used.

Figure 7:
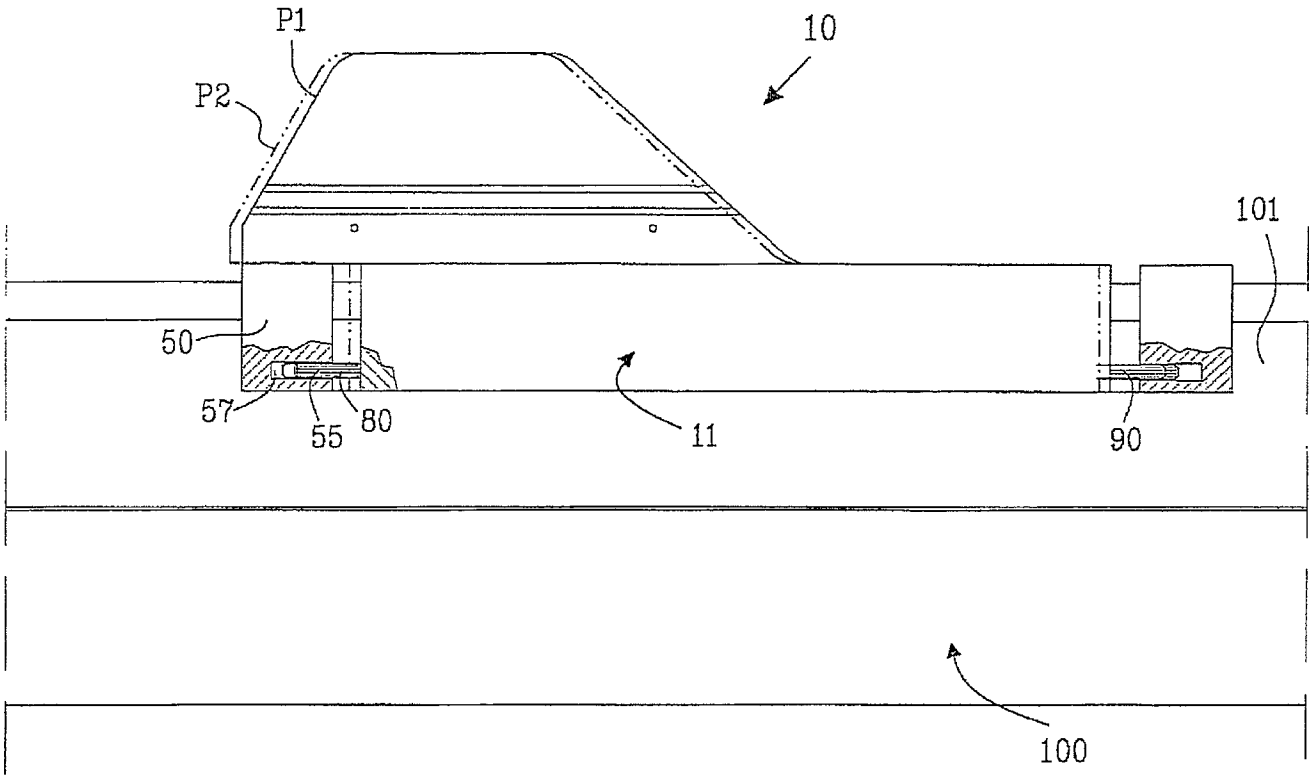
FIG. 7 shows an embodiment of the optical aiming device.

FIG. 7 shows an embodiment of the present invention in which the force absorbing members 80, 90 are formed integrally with the guiding pins 55. The guiding pins 55 are in the shown embodiment formed by a material which is relatively resilient but still somewhat flexible or compressible. A suitable material could be thermoplastic polymers such as polyethylene, polypropylene, polyurethane or mixture thereof, rubber or rubber like materials would also be appropriate.

Figure 8:
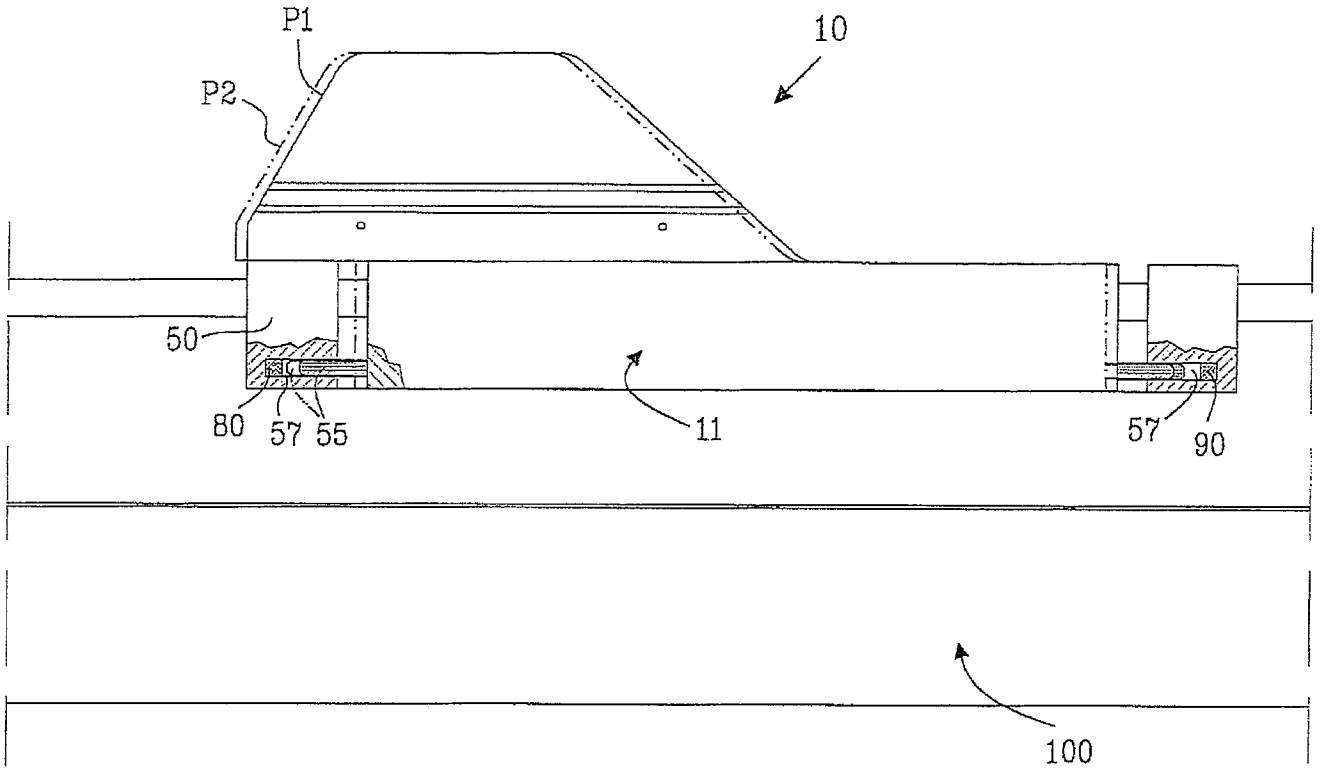
FIG. 8 shows an embodiment of the optical aiming device.

FIG. 8 shows an embodiment according to the present invention in which the force absorbing member 80, 90 is arranged inside of the guiding groove 57. In the shown embodiment, all guiding grooves 57 comprise a force absorbing member 80, 90. It should be noted that the aiming device 10 can comprise both force absorbing members in the form of guiding pins, as described with respect to FIG. 7, and force absorbing members as described with respect to FIGS. 2-6 and to FIG. 8 in combination as this would give additional force absorbing properties.

The invention claimed is:

1. An optical aiming device comprising;

a base part having a longitudinal centre axis, a distal and a proximal end;

an attachment arrangement that attaches said aiming device to a weapon having a barrel and an aiming bridge;

said base part comprising a mirror or lens;

a light source, said light source being arranged to project light on said mirror or lens, wherein said mirror is arranged to reflect or redirect at least parts of said light in a first direction, said projected light forming a sight;

wherein said attachment arrangement comprises at least a first attachment member for attaching said base part directly to said aiming bridge, wherein said base part is after assembly with said weapon enabled to move with respect to at least said first attachment member along said longitudinal centre axis between a first and a second relative position as a function of a recoil force imparted to said base part during firing of said weapon, said base part is guided along said longitudinal centre axis with respect to at least said first attachment member by means of at least two guiding pins and guiding grooves, said guiding pins extending substantially parallel with said longitudinal centre axis, and wherein said base part comprises a barrel receiving groove configured to encompass a portion of said barrel of said weapon after said optical aiming device is attached to said aiming bridge, said first attachment member comprises a through hole for a light sensor arrangement, wherein said through hole is positioned near a first longitudinal side of said base part at level with the aiming bridge after said assembly of the aiming device with said weapon.

2. The optical aiming device according to claim 1, wherein said optical aiming device further comprises at least one force absorbing member adapted to absorb at least parts of said recoil force imparted to said base part.

3. The optical aiming device according to claim 2, wherein said at least one force absorbing member is arranged between said first attachment member and said base part.

4. The optical aiming device according to any preceding claims, wherein said optical aiming device further comprises a second attachment member, said first and second attachment members being arranged at said distal and said proximal end respectively of said base part.

5. The optical aiming device according to claim 4, wherein a force absorbing member is arranged between said second attachment member and said base part.

6. The optical aiming device according to claim 1 wherein said first and/or second force absorbing member is made from a resilient material.

7. The optical aiming device according to claim 1, wherein said at least one guiding pin is arranged on said base part and said at least one guiding groove is arranged on said first attachment member.

8. The optical aiming device according to claim 7, wherein at least said one force absorbing member comprises at least one through hole through which said guiding pin is adapted to extend after assembly.

9. The optical aiming device according to claim 8, wherein said base part or said first attachment member comprises at least two guiding pins and in that said first absorbing member comprises at least two through holes through which said guiding pins are adapted to extend after assembly.

10. The optical aiming device according to claim 7, wherein said at least one guiding pin is adapted to be a force absorbing member.

11. The optical aiming device according to claim 8, wherein said at least one guiding pin is adapted to be a force absorbing member.

12. The optical aiming device according to claim 9, wherein said at least one guiding pin is adapted to be a force absorbing member.

* * * * *